US005310130A

United States Patent [19]

Wieland et al.

[11] Patent Number: 5,310,130

[45] Date of Patent: May 10, 1994

[54] CUTTING DEVICE FOR A WINDING MACHINE FOR WINDING A WEB OF MATERIAL, PARTICULARLY A PAPER WEB

[75] Inventors: Martin Wieland, Niederstotzingen; Hans-Albrecht Ruff, Heidenheim, both of Fed. Rep. of Germany

[73] Assignee: J. M. Voith GmbH, Fed. Rep. of Germany

[21] Appl. No.: 962,471

[22] Filed: Oct. 16, 1992

[30] Foreign Application Priority Data

Oct. 17, 1991 [DE] Fed. Rep. of Germany ..... 4134361

[51] Int. Cl.[5] ..... B65H 19/26

[52] U.S. Cl. ..... 242/56 R; 242/66

[58] Field of Search ..... 242/56 R, 65, 66

[56] References Cited

U.S. PATENT DOCUMENTS

| | | | |
|---|---|---|---|
| 4,157,794 | 6/1979 | Brandauer et al. | 242/66 |
| 4,345,722 | 8/1982 | Kuhn | 242/56 R |
| 4,368,855 | 1/1983 | Schönmeier et al. | 242/56 R |
| 4,444,360 | 4/1984 | Kaipf et al. | 242/56 R |
| 4,516,735 | 5/1985 | Snygg | 242/56 R |
| 4,552,316 | 11/1985 | Dropczynski et al. | 242/66 X |
| 4,789,109 | 12/1988 | Kyytsonen et al. | 242/66 X |

FOREIGN PATENT DOCUMENTS

| | | | |
|---|---|---|---|
| 2547802 | 12/1984 | France | 242/56 R |
| 59-57849 | 4/1984 | Japan | 242/56 R |
| 60-232358 | 11/1985 | Japan | 242/56 R |
| 2050317 | 1/1981 | United Kingdom | 242/56 R |

*Primary Examiner*—Daniel P. Stodola
*Assistant Examiner*—John P. Darling
*Attorney, Agent, or Firm*—Ostrolenk, Faber, Gerb & Soffen

[57] ABSTRACT

A cutting device for a winding machine for winding a web of material, particularly a paper web, the winding machine having two support rollers, one of the support rollers being partially wrapped by the web of material which is advanced upward from underneath the support rollers and introduced into a space between the support rollers, to be wound into a finished roll which rests on the winding bed formed by the two support rollers. A tiltable cutting device includes a blade, a blade carrier, a connecting link, and a support structure. The blade carrier and the support structure are pivotally connected to each other by the connecting link in such a manner that the blade carrier can be tilted into a position in which the blade faces the web of material while the opposite end of the blade carrier rests against the outer surface of the unwrapped support roller.

8 Claims, 5 Drawing Sheets

CUTTING DEVICE FOR A WINDING MACHINE FOR WINDING A WEB OF MATERIAL, PARTICULARLY A PAPER WEB

BACKGROUND OF THE INVENTION

1. Field of the Invention

The present invention relates to a cutting device for a machine having two support rollers which form a winding bed where a roll of finished material, such as a paper web, is wound, one of the support rollers being partially wrapped by a web of material, and the cutting device being advanced upward from underneath the rollers and introduced into a space between the support rollers for cutting the web of material after the roll has been wound.

2.Description of the Prior Art

A winding machine is shown in Federal Republic of Germany 31 09 587 C1 and involves taking measurements between the blade and the outer surface of the roller in order to avoid damage to the drive surface of the web-wrapped roller by the blade during cutting of the web. For this purpose, the blade carrier has associated with it a holding member which can rest on the paper web, and thus on the outer surface of the web-wrapped roller, at the time of cutting, so that a certain minimum distance remains between the cutting edge of the blade and the outer surface of the roller.

Another winding machine is disclosed by Federal Republic of Germany AS 29 30 474. Here, the narrow edge of a holding member 10, which is provided with recesses, cooperates with a perforating blade 21 which includes corresponding tabs. The blade is moved towards the holding member substantially in the circumferential direction of the support roller and remains at a distance from the surface of the support roller. In this manner, separate mountings are provided for the holding member and the perforating blade, and a separate swing drive for each is required.

Reference is made to Federal Republic of Germany OS 29 20 707 where the cutting edge of a blade is pressed against the outer surface of corresponding support roller, as a result of which the roller may be damaged.

Federal Republic of Germany OS 26 38 368 concerns a winding machine in which a cutting device is moved via a pneumatic unit from above, over one of the two support rollers, and against the paper web to be cut, operating in a manner different from the present invention.

The winding machine in accordance with Federal Republic of Germany 41 28 095 A1 which corresponds to U.S. Ser. No. 07/931,244, now U.S. Pat. No. 5,271,573, solves a particular problem which arises when cutting heavy stiff papers. If the finished wound roll is pushed out of the winding bed so that the web to be cut rests under tension against the cutting edge of the blade, a force is thereby exerted on the blade and thus on the blade carrier as well as on the entire web cutting device. The web cutting device consists in general of a machine-wide plate which is supported on both ends. This plate, and possibly the blade carrier, are bent due to the action of the above forces. If the blade is no longer particularly sharp, as a result of bending, the web may not be cut at all.

In accordance with this problem, the blade carrier is arranged as a double lever, one end of which bears the blade while the other end (the support end) forms, during the cutting process, the support for the blade carrier on the outer surface of the web-free support roller, so that a self-locking mounting of the blade carrier takes place.

The disclosures of all prior art materials mentioned herein are expressly incorporated by reference.

Such a machine has been proven excellent in practice. However, once again, the problem arises that the open space within the winding bed, formed between the two support rollers, is limited in its upper region by the outer surface of the paper roll. If the paper roll has a large diameter, it does not extend far enough into the space between the two support rollers. But, on the other hand, if the paper roll has a small diameter it may extend too far downward into the space between the two support rollers. Thus, the height of the space between the two support rollers in the region of the winding bed varies depending upon on whether a paper roll of large diameter or a paper roll of small diameter is resting on the support rollers.

In this machine, when the cutting device is brought into position, it is moved upward a given distance by a suitable means, namely to such an extent that the blade carrier can be tilted into an inclined position, where one blade-bearing end faces the web of goods while the other end, the support end, rests against the outer surface of the support roller that is not wrapped by a web. After the blade carrier has been tilted into the inclined position, the entire cutting device, including the blade carrier, is then lowered a small distance. This means that before cutting the web, the described cutting device must be moved to a somewhat higher position than is necessary to perform the cutting work. In view of the limitation of the space between the two support rollers, as described above, this can be critical in the case of a roll having a small diameter, where the height of the space is not sufficient to initially raise the cutting device to the necessary height.

SUMMARY OF THE INVENTION

An object of the present invention is to solve the foregoing problem, and more particularly provide a cutting device for a winding machine wherein the space defined by the height of the winding bed can be better utilized, so that the cutting device need not be moved up so high to be placed in position for cutting the web. Thus, dependable operation is assured even when winding paper rolls having smaller diameters.

In accordance with a feature of the invention, the winding machine comprises first and second support rollers which are parallel and separated to form a space therebetween, forming a winding bed for receiving a roll of the web of material, with the first roller being partially wrapped with the web of material, and a web cutting device which can be inserted upward from below the rollers into the space formed by the first and second rollers for cutting the web.

The cutting device may include a support, a blade carrier having opposed ends, one end of the blade carrier supporting a blade and the other end being pivotally connected to the support, and a connecting link pivotally connected between the support and the blade carrier.

The blade carrier is capable of being tilted in the space in the winding bed into a position in which the end supporting the blade faces the web of material partially wrapped on the first roller, and the other end rests against a surface of the second support roller.

Other features and advantages of the present invention will become apparent from the following description of the invention which refers to the accompanying drawings.

BRIEF DESCRIPTION OF THE DRAWINGS

The invention will be explained below with reference to the drawings, in which.

DETAILED DESCRIPTION OF THE INVENTION

Figure 1:
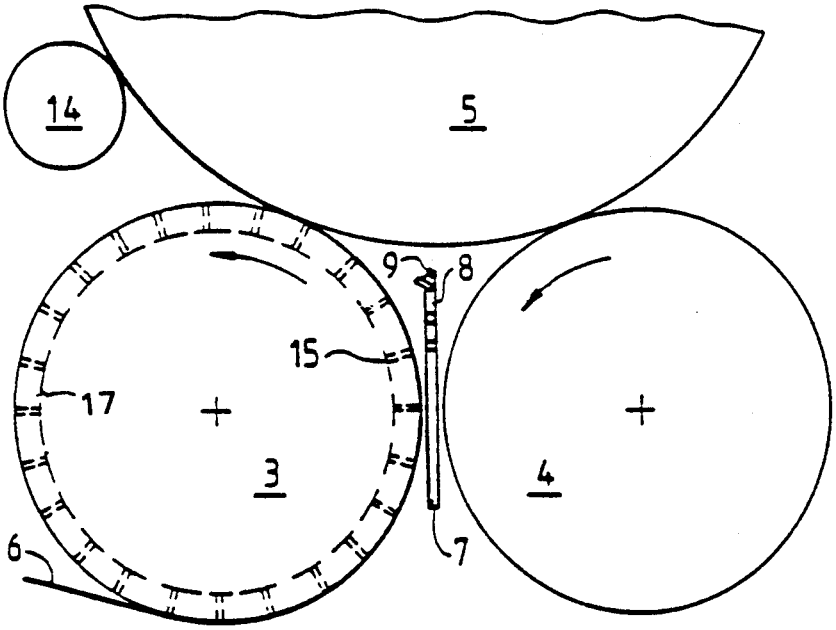
FIG. 1 is a side view of the rollers and cutting device of the present invention.

In FIG. 1, a finished paper roll 5 rests on two support rollers 3 and 4 of a support-roller winding machine. A web of material 6 runs up from below and is partially wrapped around the support roller 3, and has not yet been separated from the finished roll 5.

Between the two support rollers 3 and 4 a cutting device is raised upward from below the rollers by suitable means and is inserted into the space formed between the support rollers 3 and 4 and the roll 5. The cutting device includes a support 7 which is guided on both sides into the space. The support 7 includes a blade carrier 8 swivelably mounted on one end thereof. A tear blade 9 is disposed on the other end of the blade carrier by suitable means, for example, a screw.

The roller 3 has an outer shell 17 fixed thereon. The shell 17 is provided with a plurality of holes 15. A vacuum can be applied by means (not shown) in the interior of roller 3 to supply a suction force through holes 15 to hold the web 6 against roller 3. In contrast, the support roller 4 has a smooth, continuous outer surface.

Figure 2:
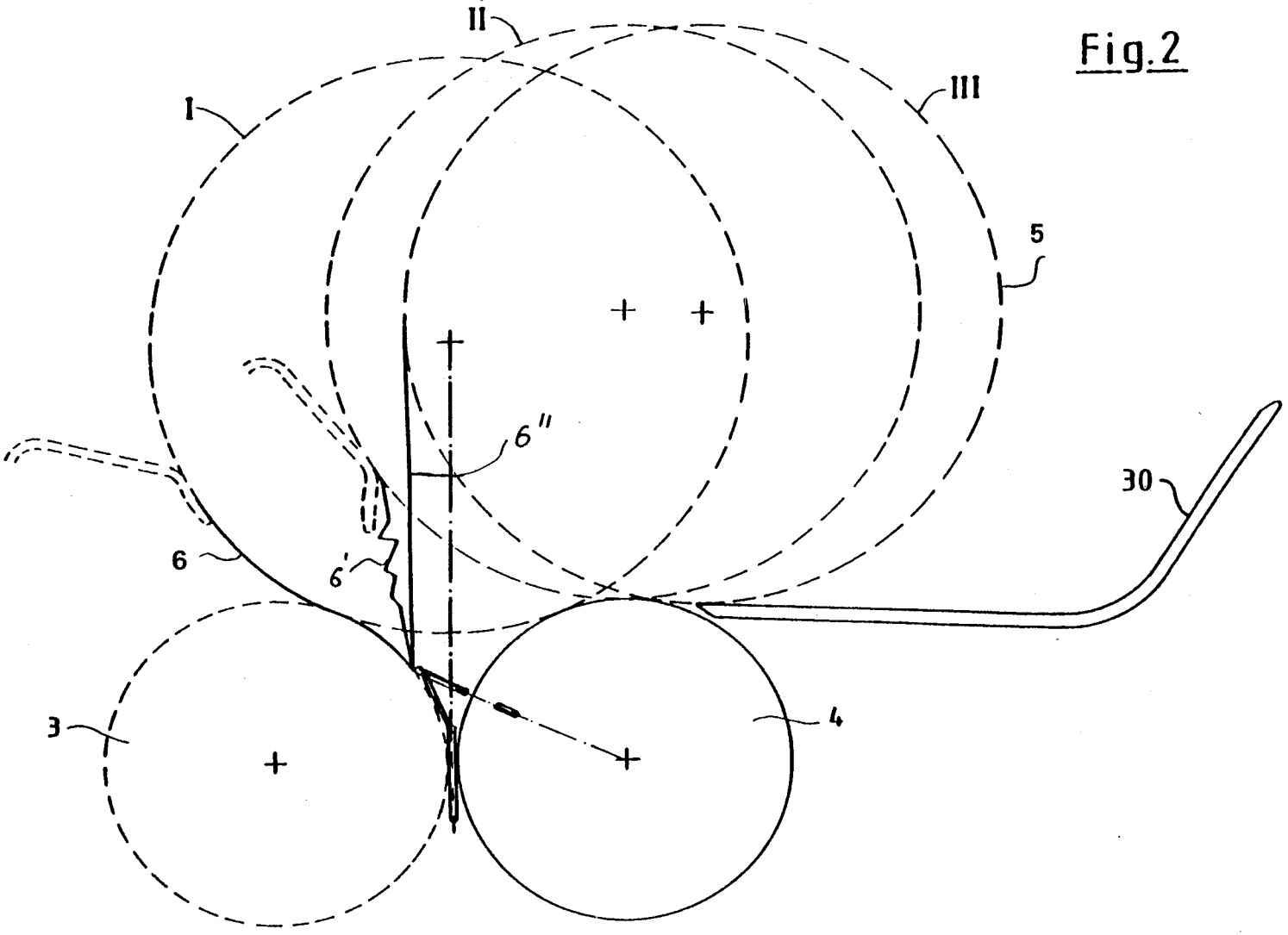
FIG. 2 illustrates the winding machine of FIG. 1 during individual phases of operation.

FIG. 2 illustrates further details of the winding machine of the present invention, in particular the contour of the paper web 6 when the paper roll 5 is being removed from the winding machine. Individual positions of the paper roll are shown in dashed lines, marked I, II and III.

If the roll 5 assumes position I, the web 6 traveling onto the support roller 3, rests fully against the outer surface thereof. In position II, paper web 6' takes an accordion-like course between the support roller 3 and the roll 5 where, due to the excess length of the web, the web forms folds.

In position III, the paper web 6" is stretched taut and has a linear course between the outer surface of the support roller 3 and the outer surface of the roll 5. In this position, the paper web already rests against the tear blade 9 of the cutting device. A movable support table 30 receives the roll 5 after the cutting of the paper web 6, and is lowerable into position to engage and remove the roll, when the roll is pushed to the right after its completion by the roller 14 (FIG. 1).

Figure 3:
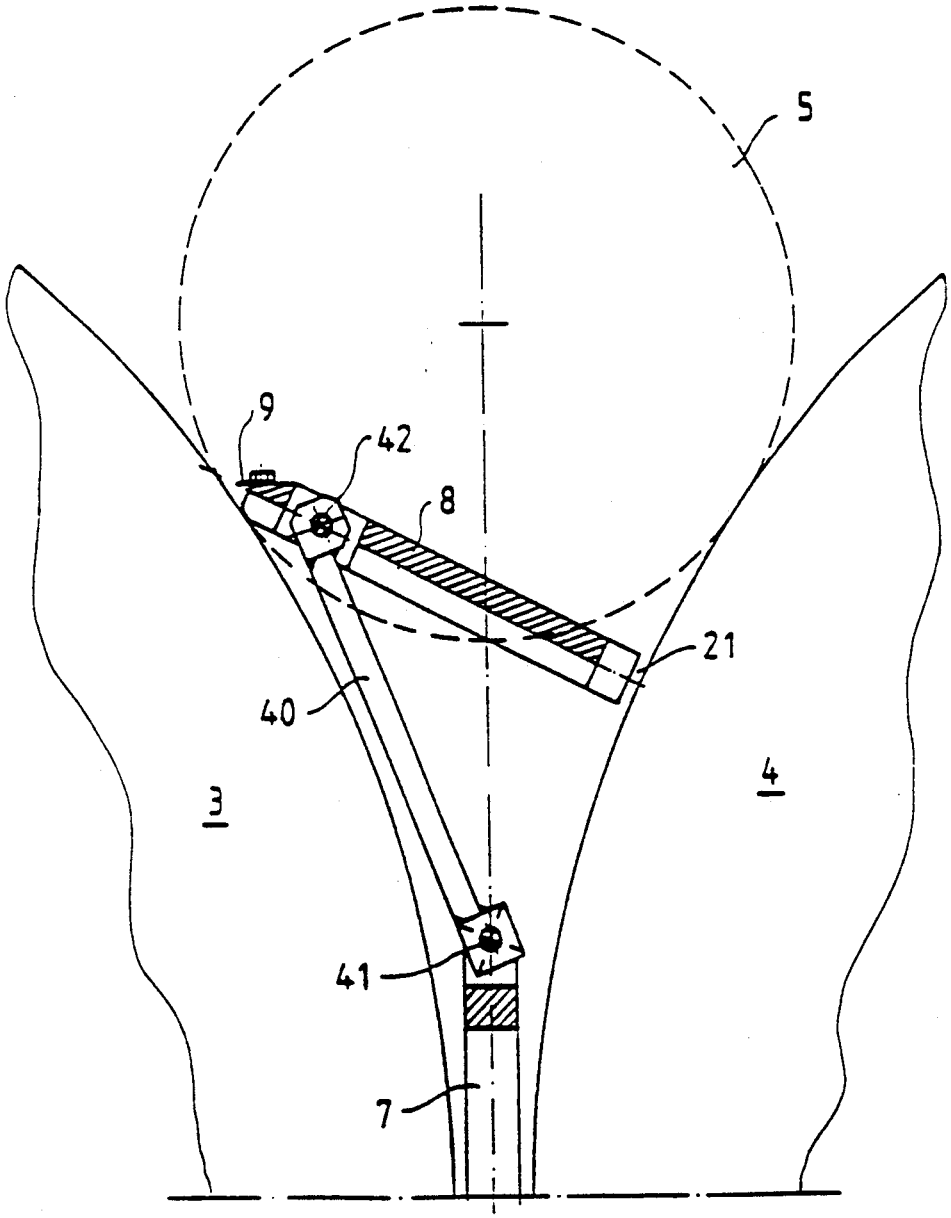
FIG. 3 is an enlarged view of the cutting device of FIGS. 1 and 2.

FIG. 3 illustrates a partial view of rollers 3 and 4 and the cutting device located therebetween. Support 7 has a plate shape and extends over the entire width of the winding machine. The blade carrier 8 has the blade 9 on its one end for cutting the web, while its other end includes a support surface 21 for resting against an outside surface of roller 4.

The blade carrier 8 is connected by a connecting link 40 to the support 7. Link 40 is connected between carrier 8 and support 7 by pivots 41 and 42. Due to this connection, the blade carrier 8 can be tilted without the entire cutting device (including the support structure 7, the connecting link 40 and the blade carrier 8) being raised to a higher level between the rollers 3, 4. Due to the action of the connecting link 40, the blade carrier 8 can begin to swing into the tilted position during its upward movement. The pivot 42 need not necessarily be at the blade-side end of the blade carrier 8. Rather, this pivot 42 could also be located somewhat further toward the center of the blade carrier 8.

The support 7 need not consist of a single beam but could, for instance, be a latticework. Furthermore, the connecting link 40, shown in side view as a bar, could be a plate or plurality of parallel bars, for example. The same is true of the blade carrier 8.

Figure 4C:
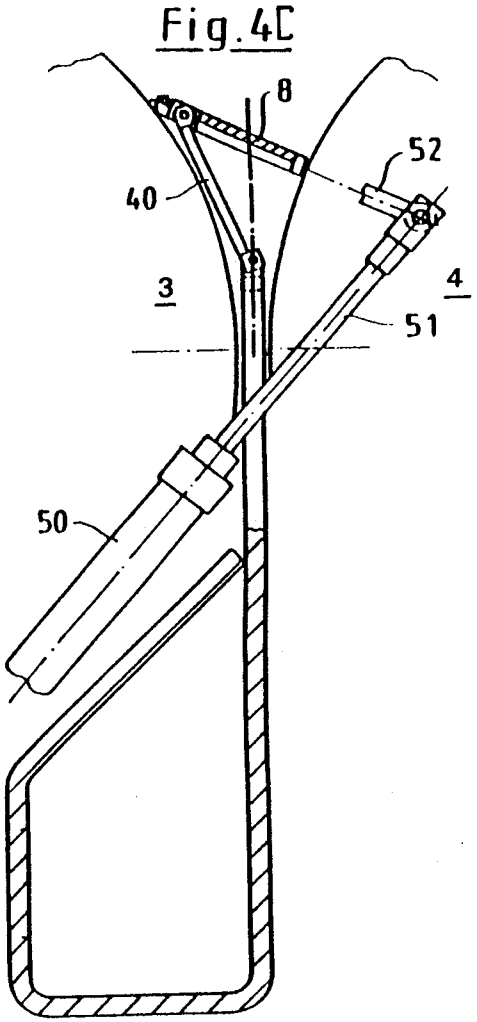
FIGS. 4A–4C illustrate three phases of the cutting process of the present invention.
Figure 4B:
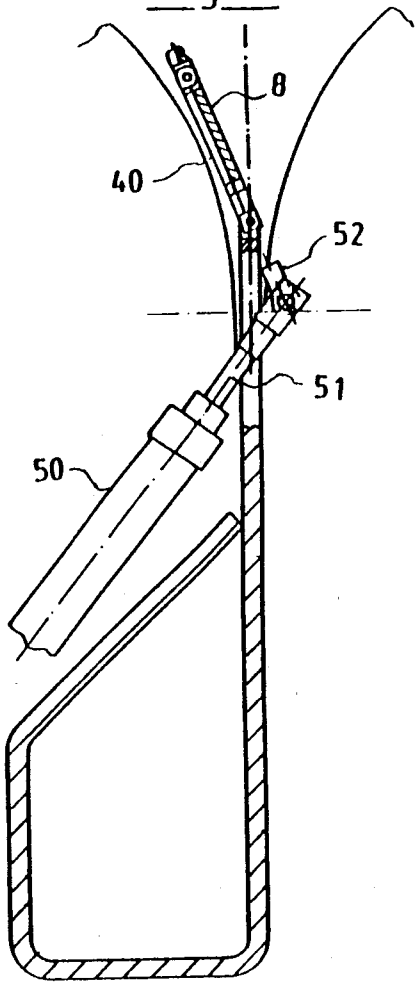
Figure 4A:
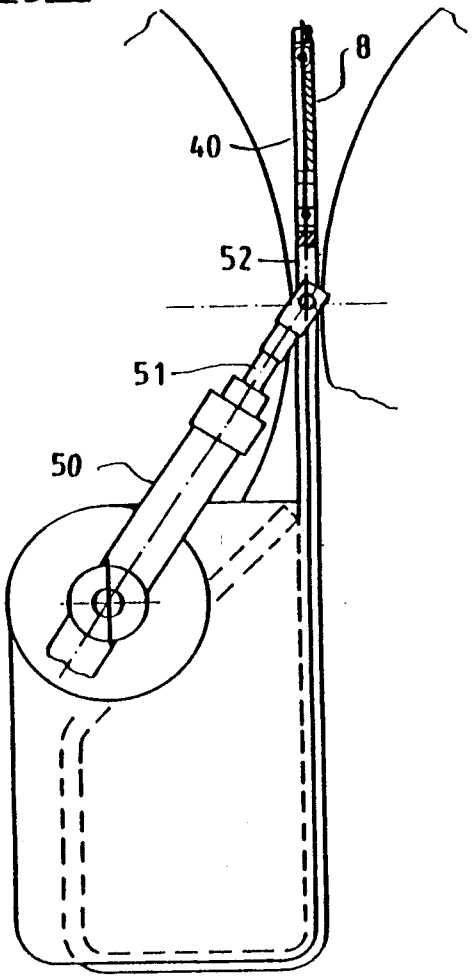

FIGS. 4A–4C illustrate three positions which the blade carrier 8, as well as the connecting link 40, can assume. In FIG. 4A the entire unit, including support 7, blade carrier 8 and connecting link 40, has moved into the basic position between the rollers 3 and 4. FIG. 4B shows an intermediate position where the blade carrier 8 has begun to tilt. FIG. 4C illustrates the operating position in which the paper web is cut. Here the blade faces the web, and the support end 21 of the blade carrier 8 rests against support roller 4.

A displacement mechanism 50 is provided for tilting the blade carrier 8 and the connecting link 40 into the position shown in FIGS. 3 and 4C. The displacement mechanism comprises a pneumatic unit with a cylinder 50, piston rod 51 and swing lever 52. The swing lever 52 acts on the support end 21 of blade carrier 8 or could be located along an extension thereof. As shown in FIGS. 4A–4C, one end of lever 52 is pivotally connected to rod 51, and the other end (shown in cutaway) is connected to blade carrier 8.

Figure 5:
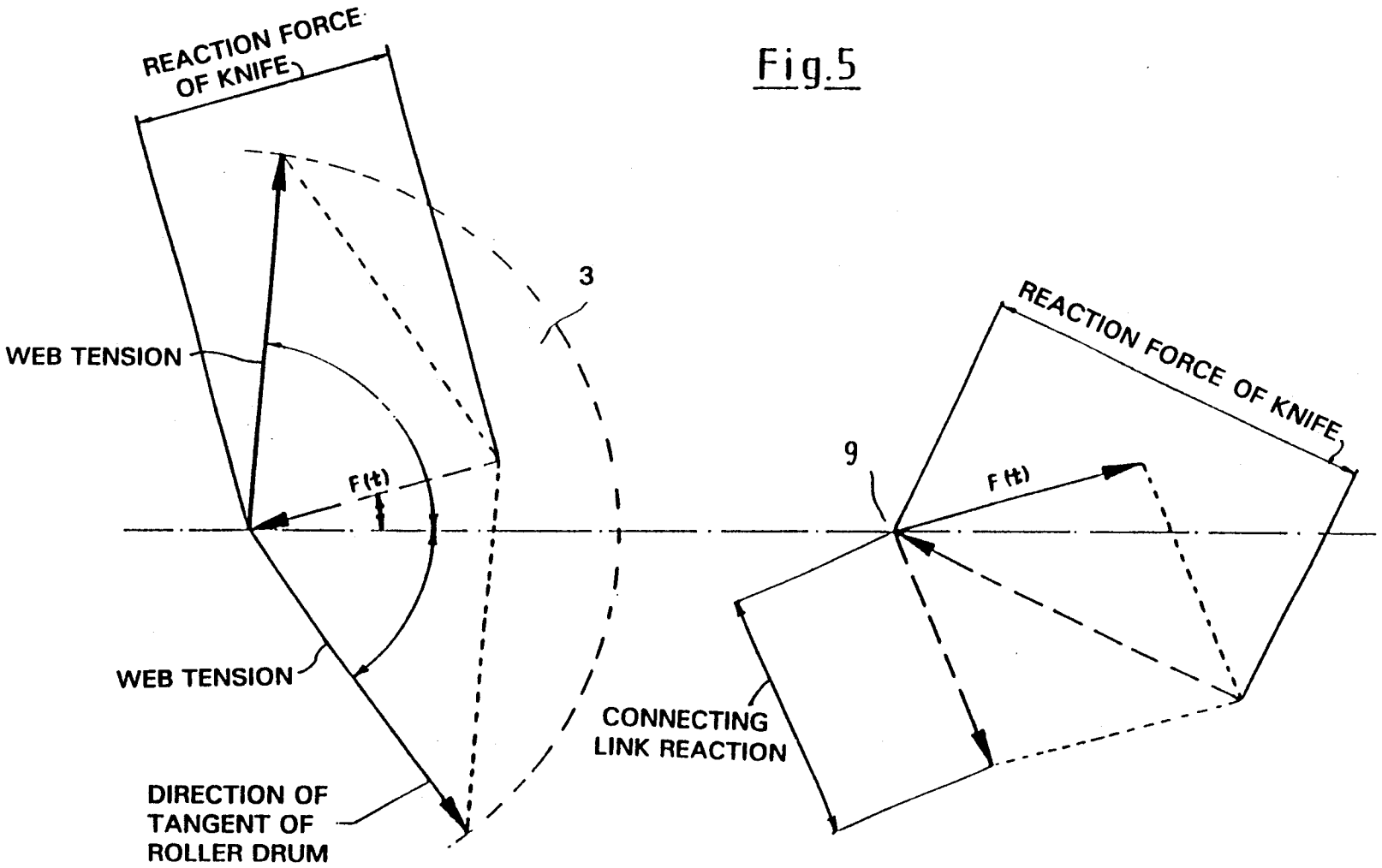
FIG. 5 shows the forces acting on the cutting edge of the blade.

FIG. 5 shows the various forces which act on the cutting edge of the blade during the cutting process. The forces produced by the tension of the web on roller 3 are illustrated, as well as the reaction forces on the blade 9 and web during separation of the web from the roll.

The present invention can be advantageously employed even if the distance between the cutting edge of the blade 9 and the outer surface of the roller 3 is large. Thus, distances of several centimeters are conceivable. The angle between the connecting link 40 and the longitudinal center plane through the roll 5 need be only minimal. It is even possible for the connecting link 40 to be absolutely vertical at the moment of cutting.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A winding machine for winding a web of material, particularly a paper web, comprising:

first and second support rollers, said first and second support rollers being parallel and separated to form a space therebetween, and together forming a winding bed for receiving a roll of the web material, said first support roller being partially wrapped by said web of material; and web cutting means inserted upward from underneath said first and second rollers into said space for cutting the web of material, said cutting means including:

a support structure, a blade carrier having opposed ends, one end of said blade carrier supporting a blade and an intermediate portion of said blade carrier being pivotally connected to said support structure, and a connecting link extending between and pivotally interconnecting said support structure and said blade carrier, wherein said blade carrier is capable of being tilted in said space into a position in which the end supporting the blade faces the web of material partially wrapped on said first roller and the other end rests at an outer surface of the second support roller.

2. The winding machine according to claim 1, further comprising a displacement mechanism connected to said blade carrier for tilting said blade carrier and connecting link in said space.

3. The winding machine according to claim 2, wherein the displacement mechanism comprises a cylinder, a piston driven by said cylinder, and a connecting lever disposed between said piston and blade carrier.

4. The winding machine according to claim 3, wherein said cylinder is a pneumatic cylinder.

5. The winding machine according to claim 3, wherein said cylinder is a hydraulic cylinder.

6. The winding machine according to claim 1, wherein said blade carrier is as an elongated bar.

7. A method of cutting a web of material in a winding machine, comprising the steps of:

inserting a cutting device upward and from underneath a pair of parallel support rollers into a space formed by said pair of support rollers and a roll of web material, one support roller being partially wrapped by said web, said cutting device including:

a support structure, a blade carrier having opposed ends, one end of said blade carrier supporting a blade and an intermediate portion of said blade carrier being pivotally connected to said support structure, and a connecting link extending between and pivotally interconnecting said support structure and said blade carrier;

tilting said blade carrier into an inclined position where the blade faces the web of material wrapped on the one support roller and the other end of said blade carrier rests at the other support roller; and cutting the web of material with said blade.

8. The method of claim 7, wherein said step of tilting said blade carrier further comprises the step of actuating a displacement mechanism connected to said blade carrier for tilting said blade carrier and connecting link, said displacement mechanism including a cylinder, a piston driven by said cylinder and a connecting lever disposed between said piston and blade carrier.

* * * * *